US009167347B1

(12) United States Patent
Silberberg

(10) Patent No.: US 9,167,347 B1
(45) Date of Patent: Oct. 20, 2015

(54) MULTI MEDIA WIRELESS HEADPHONES

(71) Applicant: Rose Silberberg, Staten Island, NY (US)

(72) Inventor: Rose Silberberg, Staten Island, NY (US)

( * ) Notice: Subject to any disclaimer, the term of this patent is extended or adjusted under 35 U.S.C. 154(b) by 296 days.

(21) Appl. No.: 13/893,093

(22) Filed: May 13, 2013

(51) Int. Cl.
*H04R 1/10* (2006.01)
*H04R 3/12* (2006.01)

(52) U.S. Cl.
CPC ..... *H04R 3/12* (2013.01)

(58) Field of Classification Search
CPC ..... H04R 2420/07; H04R 2420/09; H04R 2420/05; H04R 2420/01; H04R 5/033; H04R 5/04; H04R 5/0335; H04R 1/1041; H04R 1/1091; H04R 1/1025; H04R 1/105; H04R 1/1016; H04R 1/1066; H04R 1/1008; H04R 1/10; H04R 1/1058; H04R 1/1083; H04R 1/02; H04R 1/04; H04R 1/1075; H04R 1/342; H04R 2201/107; H04R 2201/103; H04R 25/554; H04R 3/00; H04R 2225/55; H04R 29/008; H04R 2205/022; H04R 2430/01; H04M 1/6066; H04M 1/0254; H04M 1/7253; H04M 1/05; H04M 1/0256; H04M 1/0283; H04M 1/6025; H04M 1/0258; H04M 1/04; H04M 1/19; H04M 1/21; H04M 1/6058; H04M 1/035; H04M 2250/02; H04M 2250/74; H04M 2250/12; H04B 1/385; H04B 2001/3866; H04B 2001/3872; H04W 52/0254; H04W 4/10; H04W 4/22; H04W 52/028; H04W 52/0277; H04W 72/02; H04W 76/02; G10L 15/00; G10L 2021/02166; G10L 21/0216

USPC ..... 381/74, 309, 311, 72, 111, 92, 315, 381/377, 378, 379, 376, 375, 380, 370, 371, 381/384, 385; 455/575.2, 575.3, 575.4, 455/575.6; 700/94

See application file for complete search history.

(56) References Cited

U.S. PATENT DOCUMENTS

| | | | | |
|---|---|---|---|---|
| 4,845,751 | A | 7/1989 | Schwab | |
| 5,034,995 | A | 7/1991 | Ciccone | |
| 5,438,698 | A | 8/1995 | Burton et al. | |
| 6,466,677 | B1 | 10/2002 | Bush | |
| 6,754,361 | B1 | 6/2004 | Hall et al. | |
| 8,103,015 | B2 | 1/2012 | Meyer et al. | |
| 8,213,666 | B2 | 7/2012 | Groesch | |
| 2006/0193273 | A1 | 8/2006 | Passier et al. | |
| 2008/0058023 | A1 * | 3/2008 | Seshadri et al. | 455/569.1 |
| 2009/0181731 | A1 | 7/2009 | Seshadri et al. | |
| 2012/0039481 | A1 * | 2/2012 | McClain | 381/74 |

FOREIGN PATENT DOCUMENTS

| | | |
|---|---|---|
| WO | WO01/19054 | 3/2001 |
| WO | WO2012/097719 | 7/2012 |

* cited by examiner

*Primary Examiner* — Leshui Zhang
(74) *Attorney, Agent, or Firm* — Michael I. Kroll

(57) ABSTRACT

A wireless headphone having a headband with ear pieces that insert into the ear or encompass the ear with a headphone control module attached to said headband incorporating rechargeable power supply, transceiver, microprocessor, firmware, memory, storage, D/A, speakers, microphone and display with the display incorporated into said control module having actuators and firmware for engaging and disengaging processor resident function for uploading and downloading audio files to said wireless headphones.

10 Claims, 10 Drawing Sheets

MULTI MEDIA WIRELESS HEADPHONES

BACKGROUND OF THE INVENTION

1. Field of the Invention

The present invention relates generally to headphones and, more specifically, to multi media wireless headphones. The headphone body has ear pieces that insert into the ear or may encompass the ear, with a headband extending between said ear pieces having a headphone-function control module attached to said headband. The headphone body components further incorporates rechargeable power supply, transceiver, microprocessor, firmware, memory, storage, D/A, speakers, microphone and display with the display incorporated into said control module having actuators and firmware for engaging and disengaging headphone attributes.

The control module housing provides a multi-media port, preferably USB and optionally provides for a SD card port. The control module housing provides for an enablement wherein said control module forms an integral part of the headphone body and also provides for an enablement having a housing pivotally attached to the headphone body and further provides for an enablement of a display pivotally deployable from the control module housing with the latter enablements providing for the display to pivot into the user's peripheral vision.

The display is preferably touchscreen whereby on/off, volume and other features can be controlled through screen touch. Control module firmware provides graphical user interface (GUI) and actuators in circuit communication with the headphone components for engaging and disengaging headphone attributes.

Enabling the headphone's Wi-Fi connection through headphone firmware enables data exchange with other Wi-Fi devices and Wi-Fi-locations using the firmware's GUI.

Also envisioned by the multi media wireless headphone of the present invention is a downloadable app for mobile devices, such as smart phones, thereby increasing the functionality of the wireless headphones and ease in performing some of the more screen intensive GUI functions of the control module.

2. Description of the Prior Art

There are other headphones which provide for control features. While these headphones may be suitable for the purposes for which they where designed, they would not be as suitable for the purposes of the present invention as heretofore described.

It is thus desirable to provide headphones having microprocessor and data storage, such as 16 GB, and firmware for enabling the headphone attributes.

It is further desirable to provide a multi media wireless headphone that is Wi-Fi and Bluetooth enabled and having mute media port, preferably USB thereby Internet capable. Bluetooth is a registered trademark of the Bluetooth Special Interest Group for a wireless technology standard for exchanging data over short distances.

SUMMARY OF THE PRESENT INVENTION

A primary object of the present invention is to provide wireless headphones comprising headband with distal end ear pieces having an internal storage card for storing audio files thereon with firmware for creating, editing, and managing said audio files.

Another object of the present invention is to provide wireless headphones wherein said ear pieces may cup the ear or engage the ear canal.

Yet another object of the present invention is to provide wireless headphones where said headband provides an alternate headband enablement having a pair of opposing end portion flexible joints terminating in said ear pieces.

Still yet another object of the present invention is to provide wireless headphones having a control module fixedly attached to said headband.

An additional object of the present invention is to provide wireless headphones having a control module housing that is pivotal relative to said headband.

A further object of the present invention is to provide wireless headphones having a control module housing having a microphone therein whereby the headphone attributes can be activated or deactivated through audio command.

A yet further object of the present invention is to provide wireless headphones wherein said control module further provides a plurality of actuators for enabling and disabling a plurality of headphone attributes.

A still yet further object of the present invention is to provide wireless headphones having a control module with a display that is preferably touchscreen.

Another object of the present invention is to provide wireless headphones further comprising rechargeable power supply, transceiver, microprocessor, firmware, memory, storage, D/A, speakers, microphone and display with the display incorporated into said control module.

Yet another object of the present invention is to provide wireless headphones wherein said control module further provides a multi media port, preferably USB port for the wired exchange of data files and transceiver circuit for wireless exchange of data using Wi-Fi, Bluetooth, or similar standard.

Still yet another object of the present invention is to provide wireless headphones with a downloadable app that can be download to a mobile device to create, edit and manage headphone attributes.

Additional objects of the present invention will appear as the description proceeds.

The present invention overcomes the shortcomings of the prior art by providing multi media wireless headphones having a headphone body with ear pieces located on the headband distal ends with a control module attached to said headband body that further incorporates rechargeable power supply, transceiver, microprocessor, firmware, memory, storage, D/A, speakers, microphone and display with the display incorporated into said control module having actuators and firmware for engaging and disengaging headphone attributes.

Further provided by the multi media wireless headphone of the present invention is a downloadable app for mobile devices, such as smart phones, thereby increasing the functionality of the wireless headphones and ease in performing some of the more screen intensive GUI functions of the control module.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
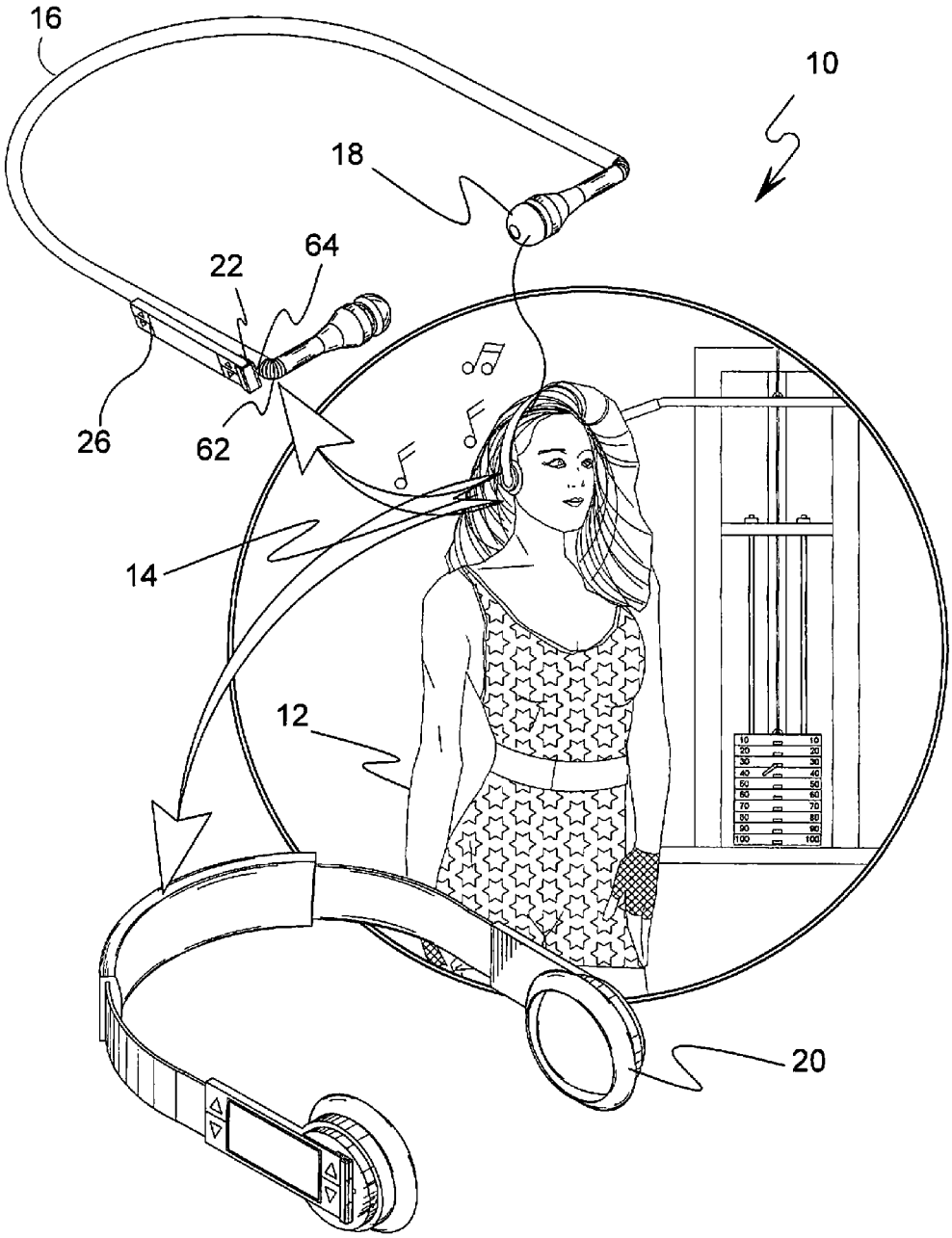
FIG. 1 is an illustrative view of the headphones of the present invention in use.

Turning now descriptively to the drawings, in which similar reference characters denote similar elements throughout the several views, the Figures illustrate the plastic pencil of the present invention. With regard to the reference numerals used, the following numbering is used throughout the various drawing figures.

10 wireless headphones
12 user
14 ears of 12
16 headphone band
18 ear pieces of 10
20 ear cover of 10
22 control module of 10
24 housing of 22
26 display of 24
28 buttons of 24
30 microphone of 24
32 USB charging port of 24
34 batteries
36 transceiver
38 storage
40 display
42 processor
44 memory
46 A/D converter
48 microphone
50 D/A converter
52 earpieces
54 smartphone
56 Wi-Fi
58 Bluetooth
60 Internet
62 elastomeric/polymeric flexible joint
64 pivot

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the headphones of the present invention in use. Shown is the wireless headphones 10 having band 16 and ear pieces 18 worn over the ears 14 of a user 12 capable of being synched to a computer or cloud network via a hard wired connection such as a USB cable, or through a wireless means such as Bluetooth, Wi-Fi or a smart phone. Additionally the present invention includes means for programming playlists, songs, streaming media and other auditory based media or media applications as the user desires. by utilizing the devices provided visual display, or computer software after synchronization, the user may direct the adding, transfer or erasing of media stored on the device, or that is transmitted to the device via a cloud, 4g or other wireless network.

Figure 2:
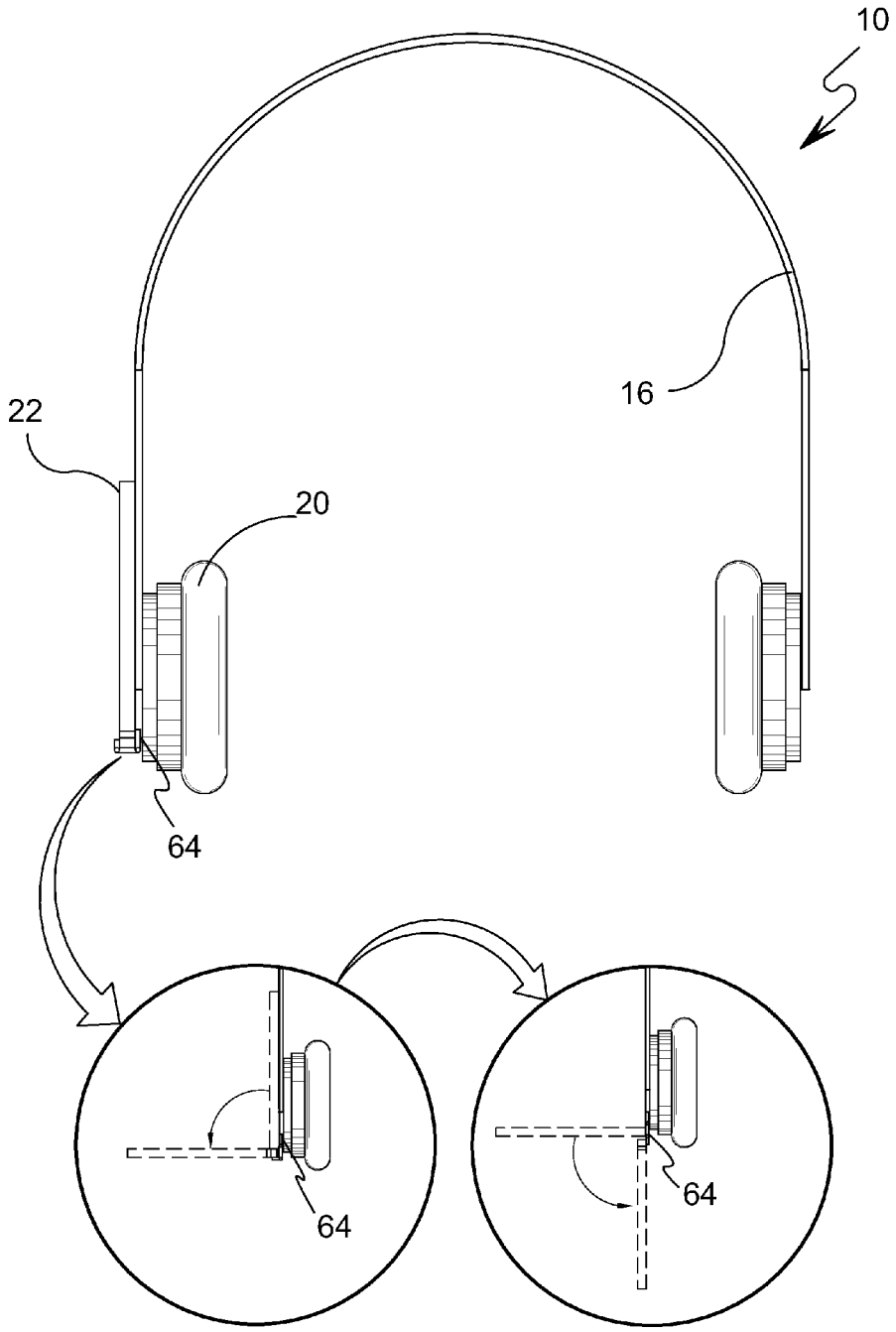
FIG. 2 is a front view of the present invention.

Referring to FIG. 2, shown is a front view of the present invention. Shown is the wireless headphones 10 having ear pieces 20 and band 16 with pivot 64 enabling movement of control module 22 having means for the programming, storing or streaming, of media such as playlists, songs, transmissions and other stereo or auditory based media and media applications.

Figure 3:
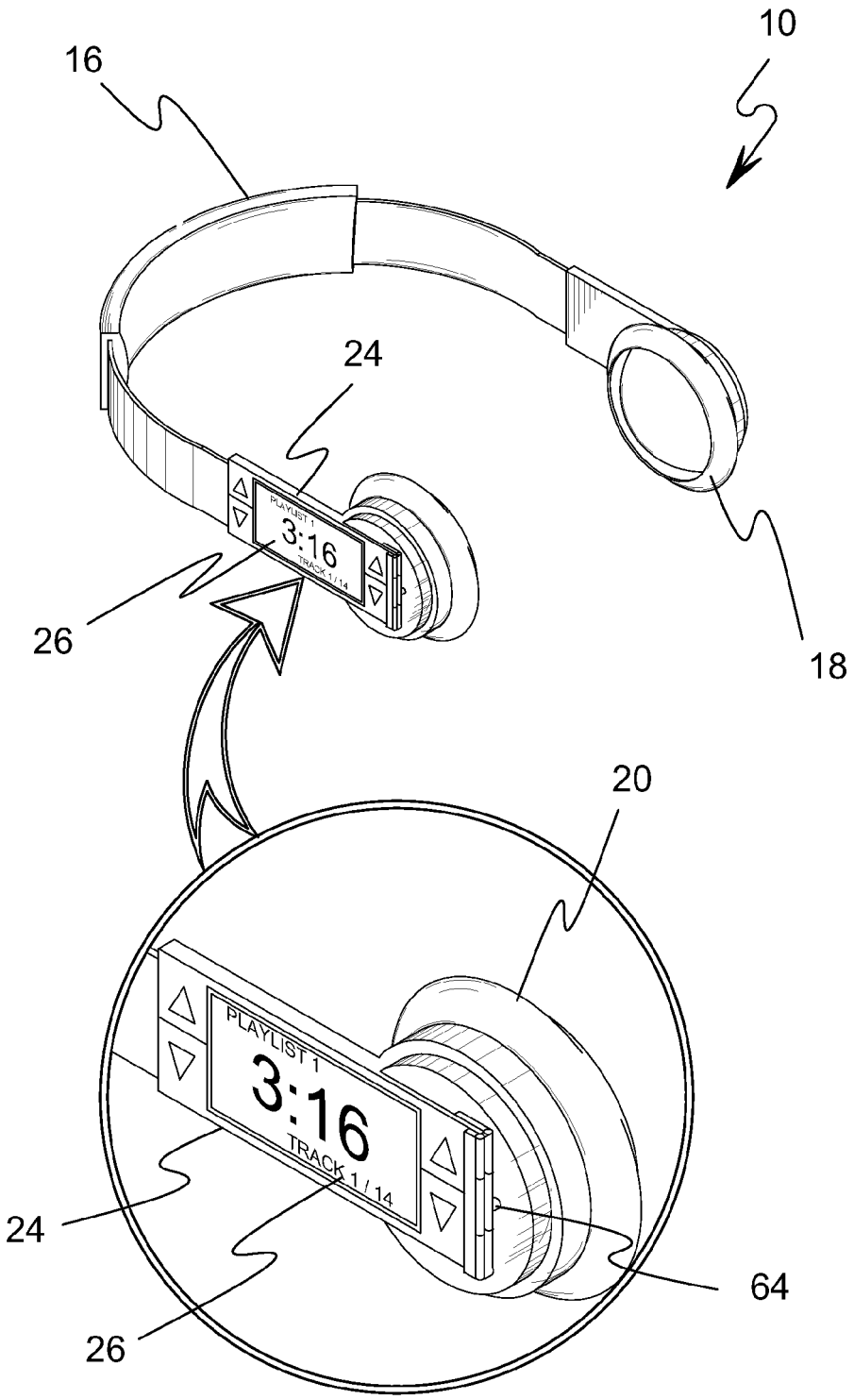
FIG. 3 is an illustrative detailed view of the present invention.

Referring to FIG. 3, shown is an illustrative detailed view of the present invention. Shown is the wireless headphone 10 having band 16 with a control module housing 24 providing display 26 capable of being synched to a computer or cloud network. The present invention provides a visual display that can be utilized with computer to allow the user to direct the adding, transfer or erasing of media stored on the device, or to regulate data transmitted to the device via a cloud, 4G or other wireless network.

Figure 4:
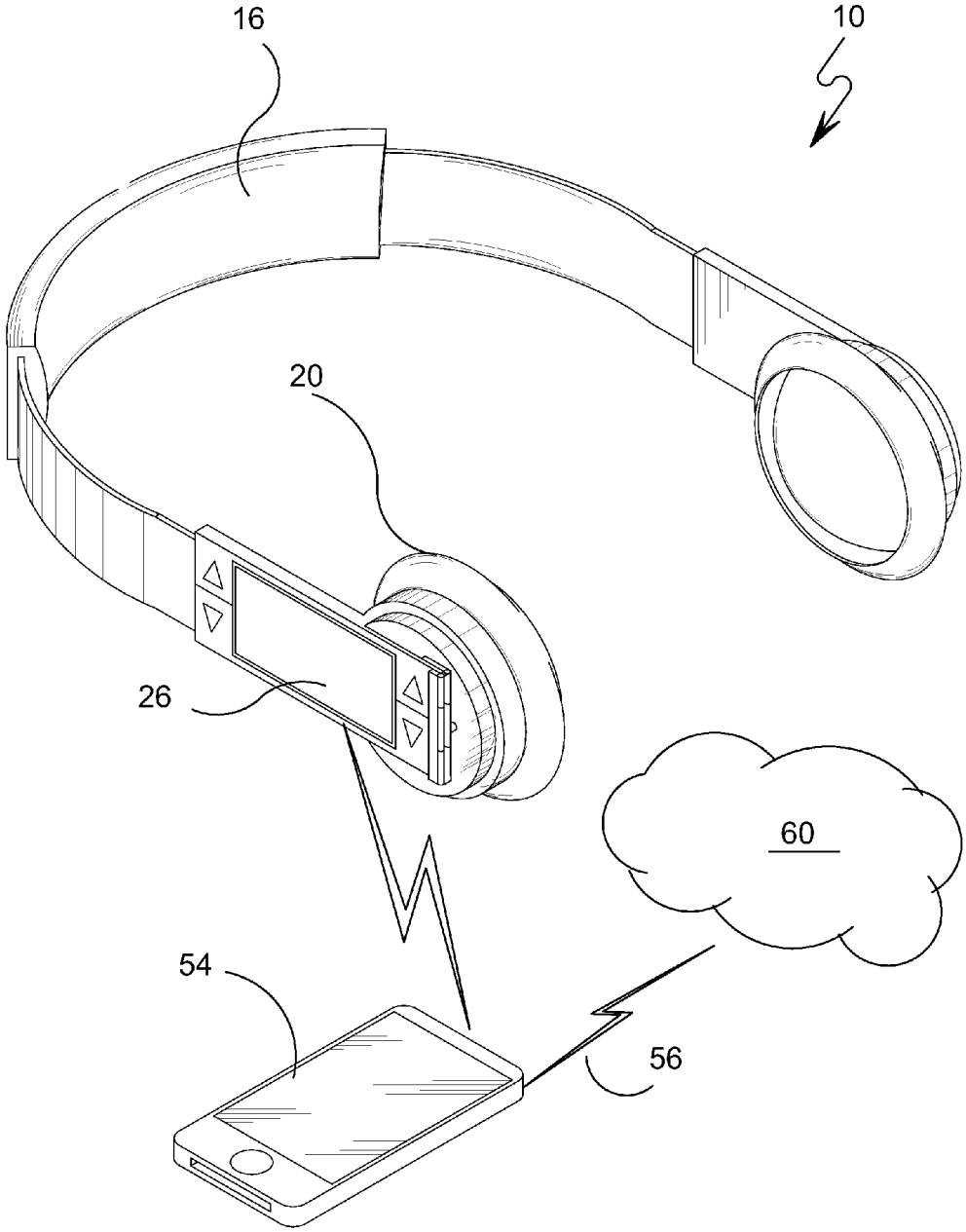
FIG. 4 is an illustrative view of the present invention.

Referring to FIG. 4, shown is an illustrative view of the present invention. Shown is the wireless headphones having band 16 with ear pieces covers 20 with the control module having a display 26 capable of being synched to a computer or cloud network 60 via a smart phone 54 app that can make a solid line of communication between the present invention and a smart phone 54 wherethen said smart phone may take and transmit information utilizing the same means and networks the users phone normally accesses.

Figure 5:
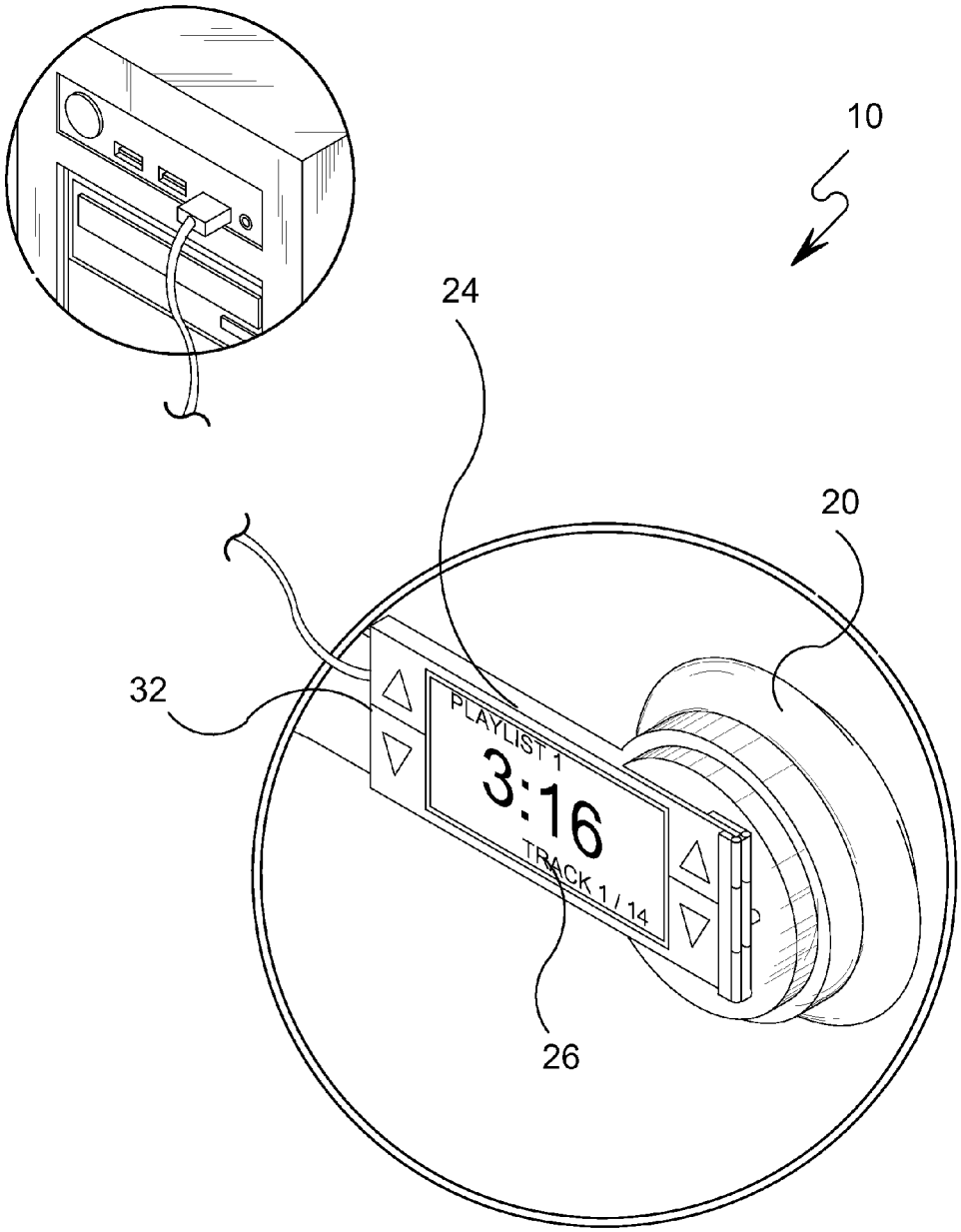
FIG. 5 is an illustrative view of the present invention in use

Referring to FIG. 5, shown is an illustrative view of the present invention in use. Shown is the control module 24 having display 26 and controls 32 of the wireless headphones 10 communicating in a plurality of different ways such as by USB cable, Bluetooth adapters or Wi-Fi wireless transmission over network devices such as computer modems, wireless LAN's or other 4G networks.

Figure 6:
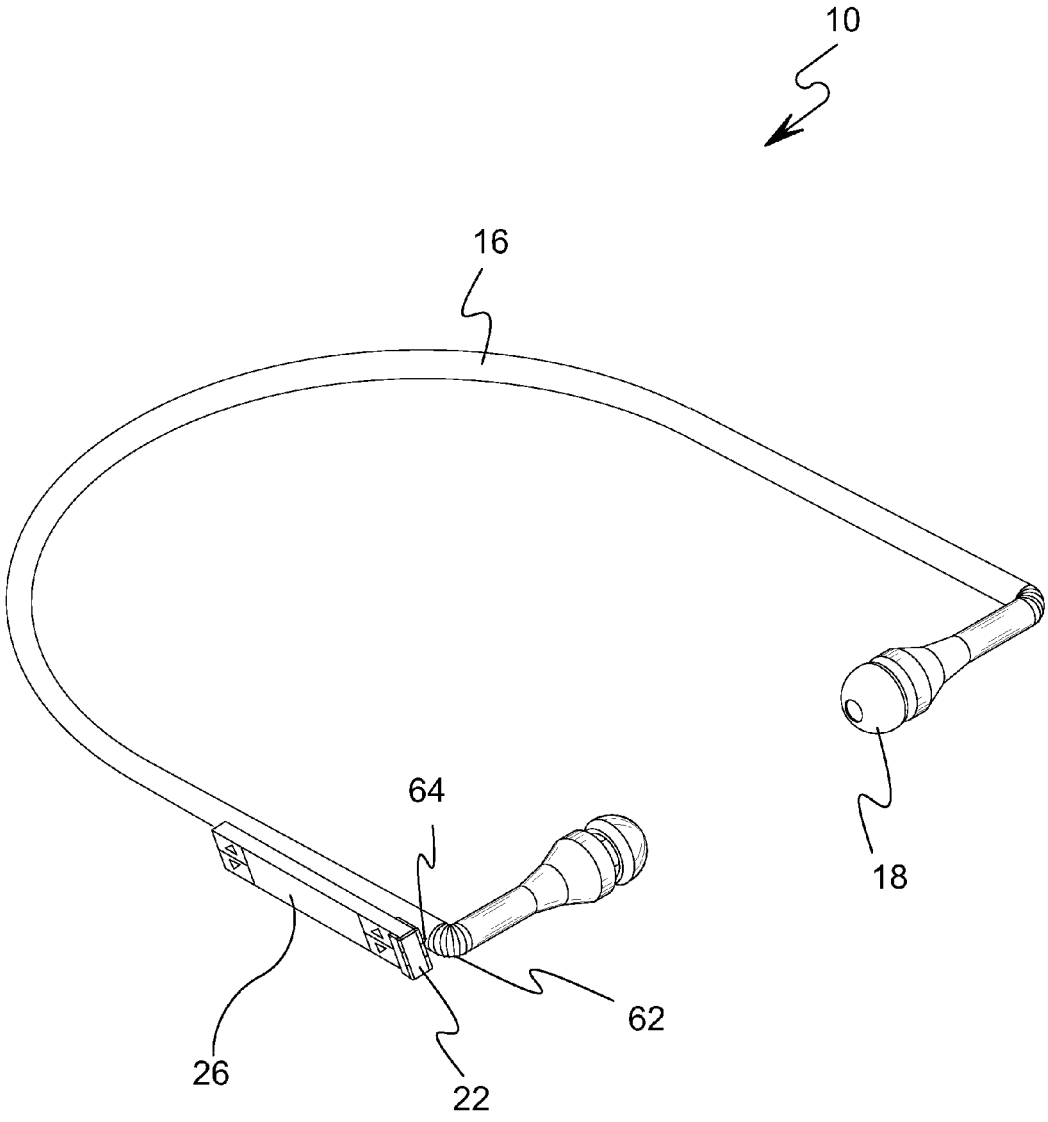
FIG. 6 is an illustrative view of the present invention.

Referring to FIG. 6, shown is an illustrative view of the present invention. Shown is the present invention, a set of headphones capable of being synched to a computer or cloud network via a hard wired connection such as a USB cable, or through a wireless means such as blue tooth or a smart phone. Additionally the present invention includes means for programming play lists, songs, streaming media and other auditory based media or media applications as the user desires. by utilizing the devices provided visual display, or computer software after synchronization, the user may direct the adding, transfer or erasing of media stored on the device, or that is transmitted to the device via a cloud, 4g or other wireless network.

Figure 7:
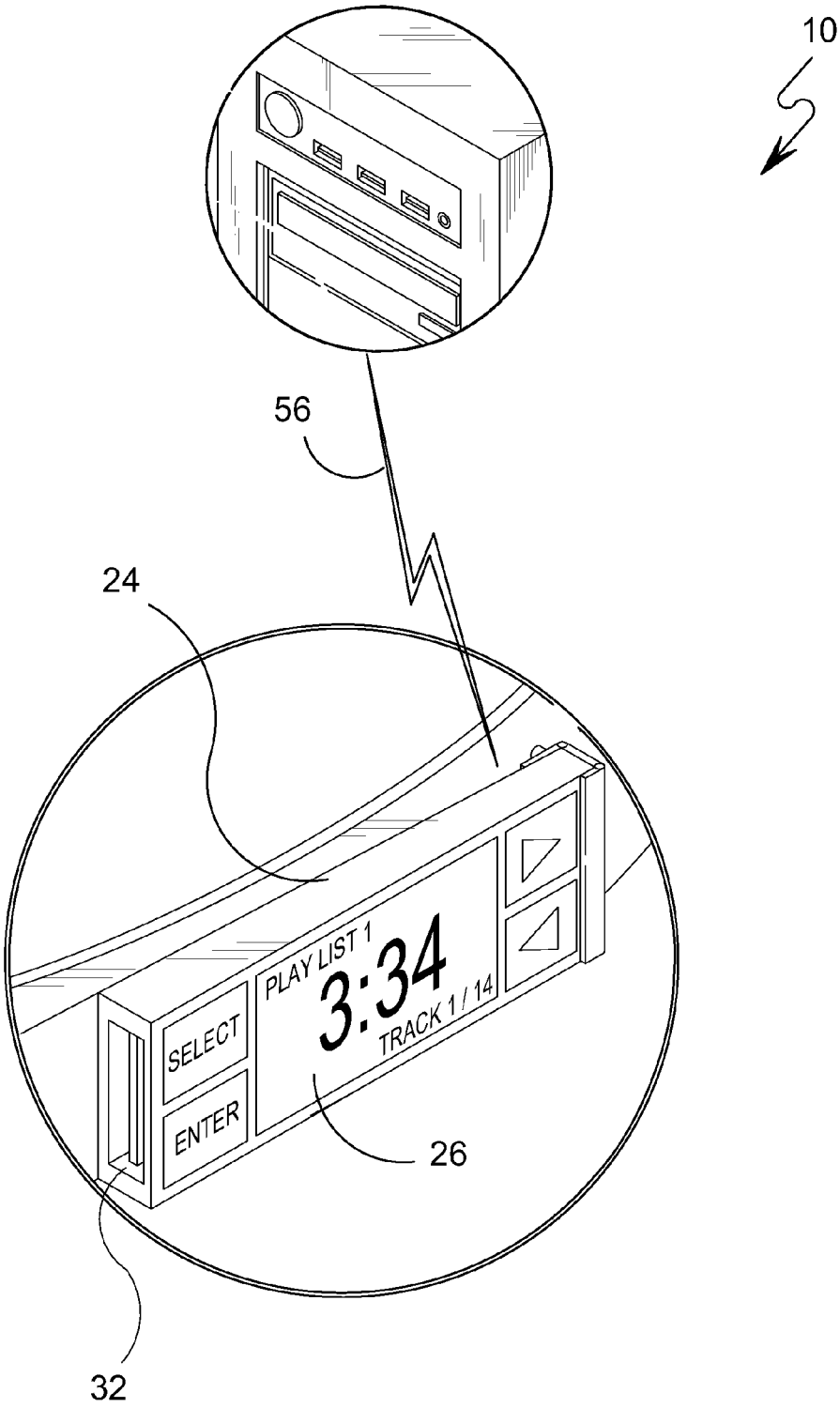
FIG. 7 is an illustrative view of the present invention in use.

Referring to FIG. 7, shown is an illustrative view of the present invention in use. Shown is the control module 24 of the wireless headphones 10 having USB charging port 32 and display 26 ommunicating in a plurality of different ways such as by USB cable, Bluetooth 56 adapters or Wi-Fi 56 wireless transmission over network devices such as computer modems, wireless LAN's or other 4G networks.

Figure 8:
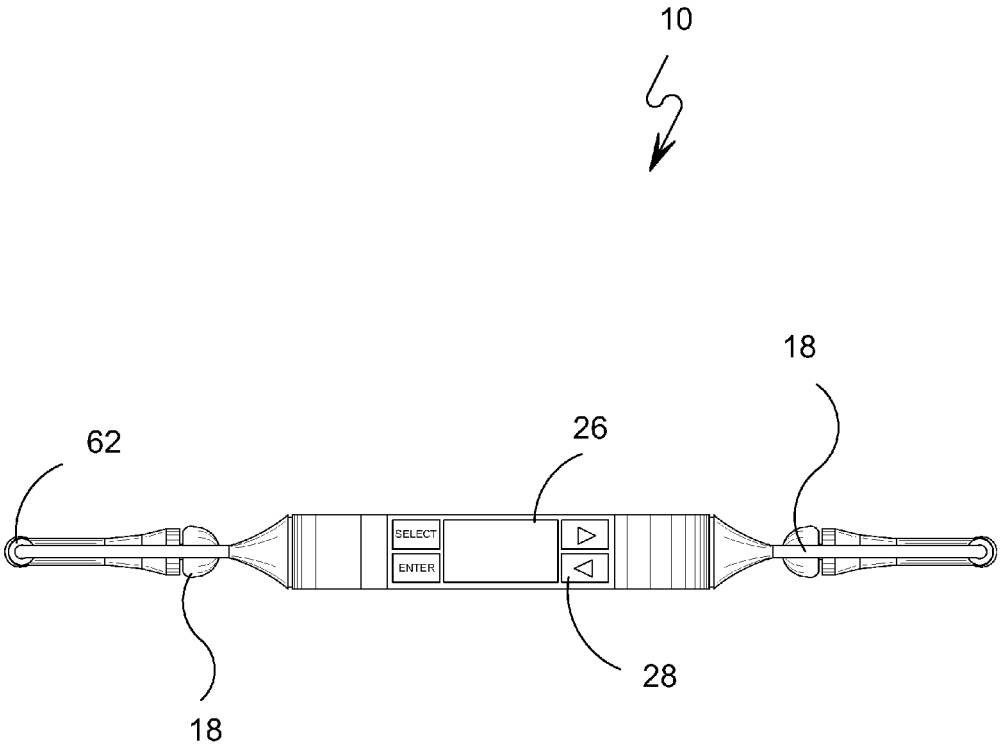
FIG. 8 is a top view of the present invention.

Referring to FIG. 8, shown is a top view of the present invention. Shown is the wireless headphone 10 having a control interface comprising housing 24 incorporating a display 26 with buttons 28 for the controlling of audio media data that the user desires to be played, stored or removed from the device Also shown are flexible connectors 62 of an elastomeric or polymeric material and ear pieces comprising ear buds 18.

Figure 9:
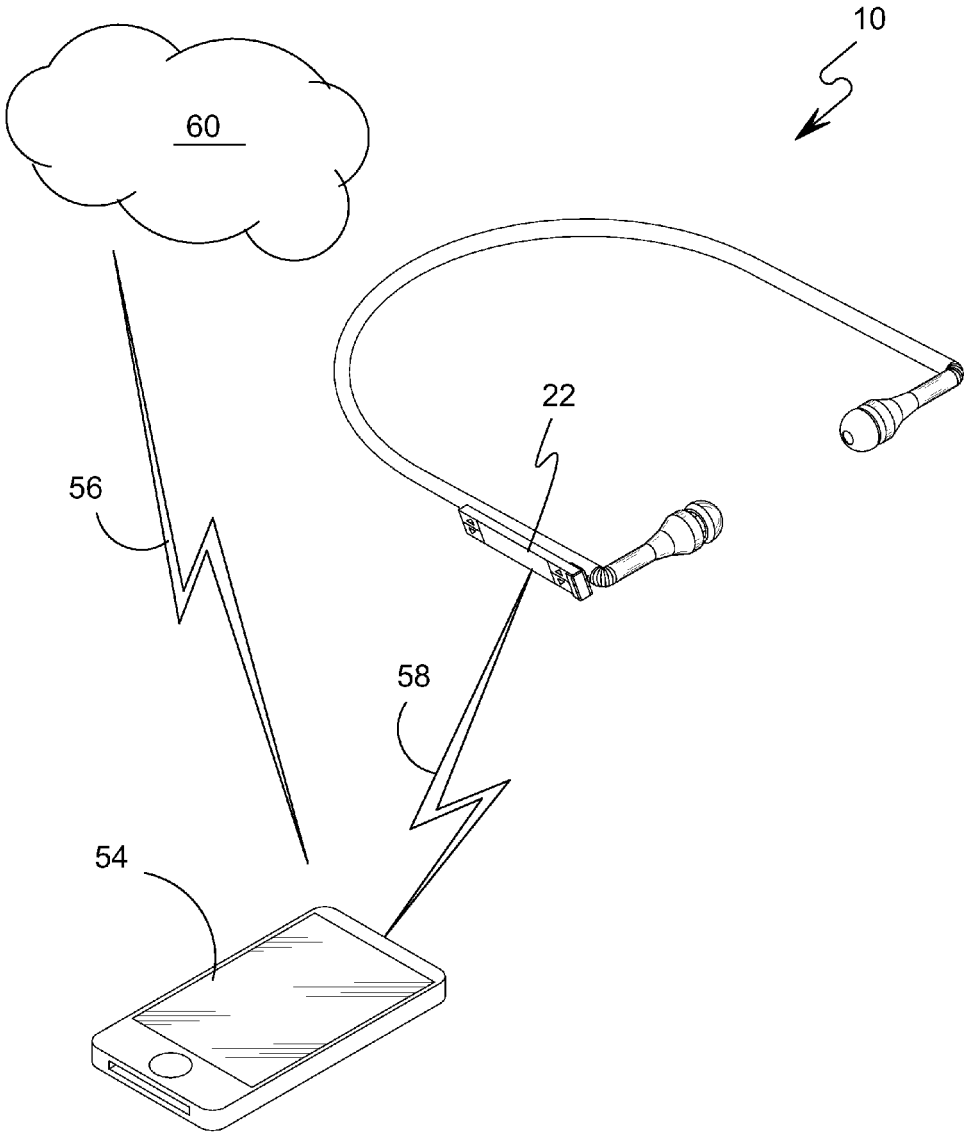
FIG. 9 is an illustrative view of the present invention.

Referring to FIG. 9, shown is an illustrative view of the present invention. Shown is the present invention being a set of headphones 10 capable of being synched to a computer or cloud network via a smart phone 54 app that can make a Bluetooth 58 connection between the wireless headset 10 control module 22 and a smart phone 54 wherethen said smart phone may take and transmit information utilizing the same means and networks the user's phone normally accesses.

Figure 10:
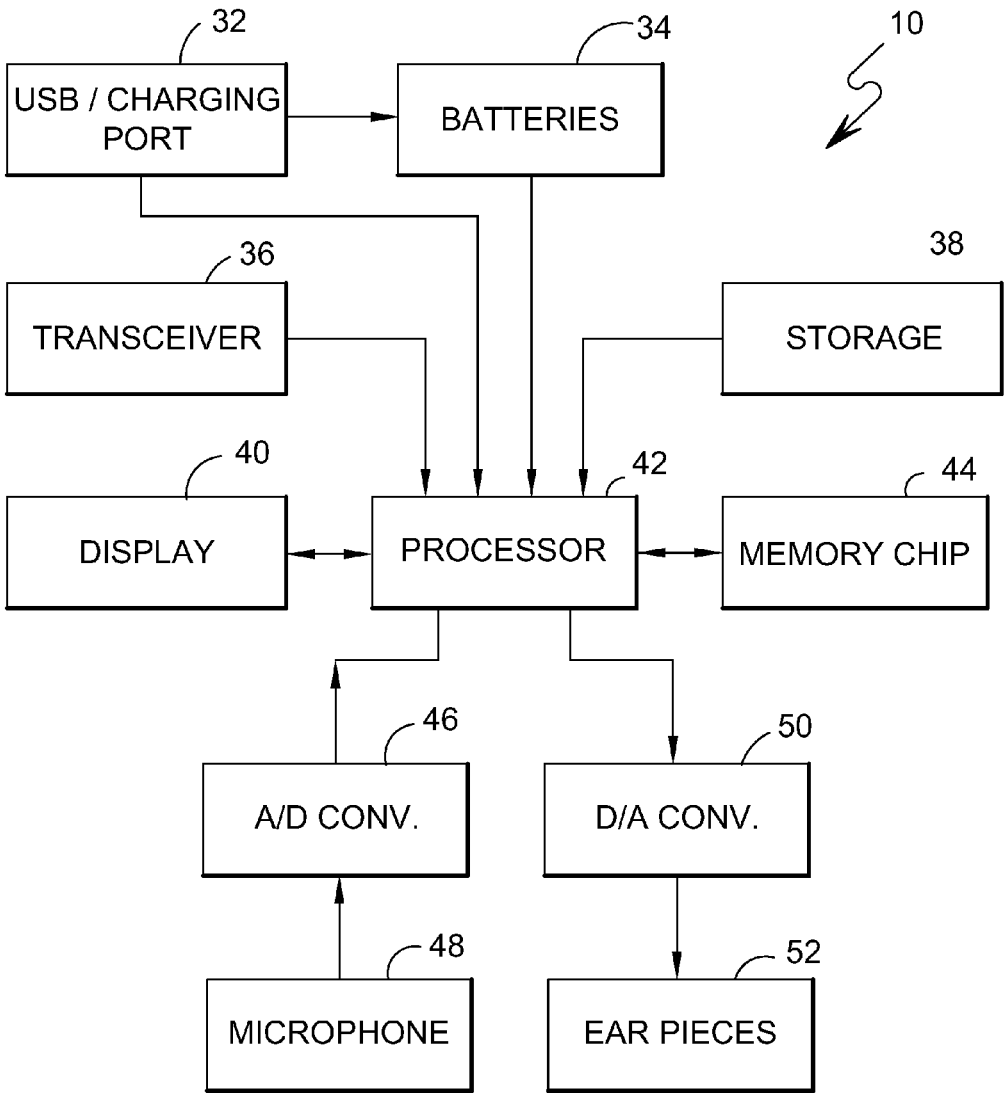
FIG. 10 is a flow chart of the present invention.

Referring to FIG. 10, shown is a flow chart of the present invention. Shown is a flow chart of the wireless headphones 10 depicting the individual components of the present invention comprising charging port 32, batteries 34, transceiver 36, storage 38, control module display 40, microprocessor 42, memory 44, analog to digital converter 46, microphone 48, digital to analog converter 50 and ear pieces 52.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A wireless headphone for storing and playing music comprising:

a) a pliable band having a pair of earpieces located on distal ends of said pliable band;

b) a control module mounted to said pliable band incorporating user controls to allow a user to selectively enable and disable various functions of said control module;

c) a power source within said control module having a recharging port for connecting said power source to an external power source for selectively recharging said power source;

d) a processor positioned within a housing of said control module and connected to said power source and a storage device in the housing and enabling the user to store audio files in and play the stored audio files from said storage device;

e) said control module being attached to said pliable band by a pivot along an end edge of the pliable band, whereby said control module is pivoted between a first position flush against an outside surface of said pliable band and a second position within a peripheral vision of said user without detaching said control module from said pliable band and without moving the pair of earpieces with respect to the pliable band.

2. The wireless headphone of claim 1 wherein said control module further provides a firmware in communication with said processor and said user controls for storing and playing said audio files within said storage device.

3. The wireless headphone of claim 2 wherein said firmware incorporates a software for creating, editing and playing at least one playlist in said stored audio files of said storage device.

4. The wireless headphone of claim 3 further comprising a microphone for wirelessly actuating the software for creating, editing and playing said stored audio files.

5. The wireless headphone of claim 4, wherein said control module further provides a display for viewing and actuating software functions of creating, editing and playing said stored audio files via said user controls.

6. The wireless headphone of claim 5, wherein said control module further incorporates a communication circuit in connection with said processor for wirelessly downloading audio files from a remote source.

7. The wireless headphone of claim 6, wherein said communication circuit in connection with said processor is compliant with a wireless technology standard for exchanging data over short distances whereby audio files can be uploaded and downloaded wirelessly from a smartphone.

8. The wireless headphone of claim 7, wherein said communication circuit in connection with said processor is Wi-Fi compliant whereby audio files can be uploaded and downloaded wirelessly from the Internet.

9. The wireless headphone of claim 8 wherein said pair of earpieces are selected from the group consisting of earbuds and ear covers.

10. The wireless headphone of claim 9 wherein said control module pivots over an angle of at least 180 degrees.

* * * * *